United States Patent [19]

Piton et al.

[11] Patent Number: 4,926,779

[45] Date of Patent: May 22, 1990

[54] MARINE ANCHOR EQUIPPED WITH ANCHOR WEIGHING MEANS

[76] Inventors: Claude Piton; Jacqueline Piton, both of 45, rue de Dinan, 22130 Plancoet, France

[21] Appl. No.: 284,140

[22] Filed: Dec. 14, 1988

[51] Int. Cl.[5] ..... B63B 21/44

[52] U.S. Cl. ..... 114/297; 114/298

[58] Field of Search ..... 114/297, 298, 299, 302, 114/303, 304, 310

[56] References Cited

U.S. PATENT DOCUMENTS

| | | | |
|---|---|---|---|
| 2,415,605 | 2/1947 | Newby . | |
| 2,511,286 | 6/1950 | Millen . | |
| 4,114,554 | 9/1978 | Miller | 114/298 |
| 4,134,355 | 1/1979 | Carruthers | 114/297 |
| 4,230,062 | 10/1980 | Fornasiero | 114/297 |
| 4,369,727 | 1/1983 | Fasco | 114/297 |
| 4,655,158 | 4/1987 | Holder . | |

FOREIGN PATENT DOCUMENTS

| | | |
|---|---|---|
| 497580 | 12/1978 | Australia . |
| 2350244 | 2/1977 | France . |
| 8300126 | 1/1983 | PCT Int'l Appl. . |

OTHER PUBLICATIONS

Search Report from the French Patent Office for the corresponding French patent application.

*Primary Examiner*—Sherman D. Basinger
*Assistant Examiner*—Stephen P. Avila
*Attorney, Agent, or Firm*—Laff, Whitesel, Conte & Saret

[57] ABSTRACT

The marine anchor has two symmetrical flukes, each one of them fitted with a pair of symmetrical ledges. Between the flukes, a shank is capable of pivoting around a transverse shaft that joins the two flukes, so as to form, relative to the shaft, a fore arm and a rear arm. The free end of the rear arm carries transverse stop-pins. An oblong aperture is provided in the shank, for the passage of a shaft that joins the flukes. The stop-pins come into abutment against the ledges of the flukes when the shaft is in the rear part of the aperture. The stop-pins are released from the ledges when the shaft is in the fore part of the aperture. The aperture has the general shape of a truncated triangle, the axis of symmetry of which is one and the same with the longitudinal axis of the shank, the long base of the truncated triangle being in the fore. Under normal conditions, elastic or breakable lug pieces limit the movements of the stop-pins when they are released from the ledges.

6 Claims, 9 Drawing Sheets

MARINE ANCHOR EQUIPPED WITH ANCHOR WEIGHING MEANS

The present invention relates to a marine anchor equiped anchor weighing means and, more especially, such an anchor the shank of which is mounted pivoting between two symmetrical flukes , within the limits of a given angle on each side of these flukes.

Generally speaking, such an anchor comprises a rectilinear shank with a means for attaching a chain or a cord at one end, and a hole near its other end. Through the hole there runs a transverse shaft welded, on each side of the shank, to a fluke the front part of which is pointed. The two flukes are symmetrical and, most often, they are flat. They are directed toward the end of the shank that has the attaching means. An abutment is provided to limit the pivoting of the shank relative to the transverse shaft, so that the shank will be angularly free, on each side of the flukes, within the limits of a sharp angle, generally close to 30°.

Close to the transverse shaft, the flukes further have transverse projections or ledges on both of their faces, to prevent them from lying flat on the bottom and thus impart to their tip a tendency to sink in.

Such an anchor proves especially efficient on sandy or muddy bottoms, but it is not rare for it to get caught when the flukes enter the hole of a rock, for example. It then happens that it is very difficult, even impossible, to pick up the anchor.

To offset that drawback, anchor weighing means have been imagined, that consist in releasing the abutments for the pivoting of the flukes. An anchor with such a means is described in French document FR=A=2 350 244. The anchor has a head mounted to pivot on a primary shaft. A secondary shaft, having an abutment to limit the pivoting of the head is also mounted in a pivoting manner on the primary shaft. In work position of the anchor, a blocking means prevents the secondary shaft from pivoting relative to the primary shaft. Beyond a certain force exerted on the anchor, the blocking means for the pivoting of the secondary shaft unlocks, and the abutment is released. That device is relatively complicated. Moreover, on a ship where it is necessary to act rapidly and under often precarious conditions of balance, it presents a real danger for the fingers.

Another anchor is described in the International Patent Application W0 83/00126. The anchor weighing means is even more complex. Furthermore, in order to operate it, it is necessary that the force of traction on the shank occur in the direction opposite the direction of sinking of the anchor. On board a ship, that opposite direction is not easy to determine.

One object of the present invention is to provide for an anchor, equiped with a weighing means, that is simple, efficient and easy to use.

According to a characteristic of the invention, the anchor has two symmetrical flukes, each one equiped with a pair of symmetrical ledges and, between these flukes, a shank capable of pivoting around a transverse shaft that joins the two flukes so as to form, relative to said axis, a fore and a rear arm, the free end of the rear arm bearing transverse stop-pins, an oblong opening being provided for in the shank, in the direction of its longitudinal axis, for the passage of the shaft that joins the flukes, a stop-pin coming to abut against the ledges of the flukes when the shaft is in the rear part of the opening, the stop-pins being released from the above-mentioned ledges when the shaft is in the fore part of the opening, the opening having the general shape of a truncated triangle the axis of symmetry of which is the same as the longitudinal axis of the shank, the long base being toward the front, and elastic r breakable lug pieces being provided to limit, under normal conditions, the movements of the stop-pins when same are free from the ledges.

According to another characteristic of the invention, the elastically removable lug pieces are formed by pin-shaped wires a first side of which is welded to one fluke and the second side of which forms a lug piece between the two flukes.

According to another characteristic of the invention, the first side of each pin is welded to two ledges symmetrically placed on each side of each fluke, in their internal rear corner.

According to another characteristic of the invention, the first sides of the two pins form a passage that limits the transverse play of the above -mentioned rear arm of the shank and that maintains the latter in the active zone of the lug pieces.

According to another characteristic of the invention, the breakable lug pieces are small plates that extend a ledge part toward the rear.

The above-mentioned characteristics of the invention, as well as others, will appear more clearly upon reading of the following description of examples of execution, that description being given in relation to the attached drawing in which.

Figure 2:
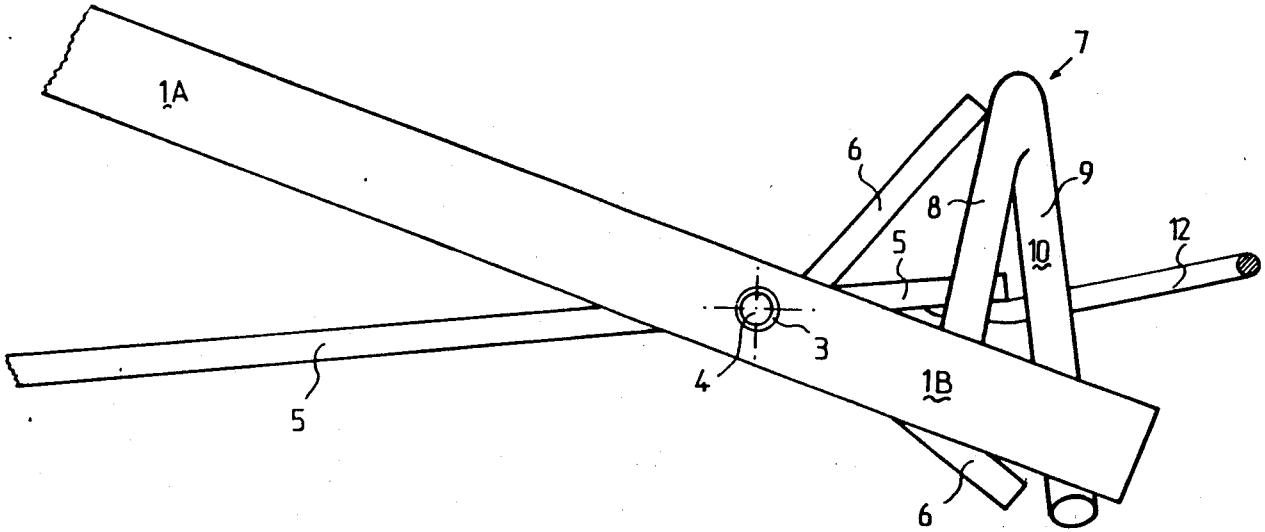
FIG. 2 is a section view, enlarged and partial, cut along line II—II in FIG. 1.

The anchor according to invention has a shank 1 one end of which, that will be considered as the fore end, has a hole 2 into which is threaded a tying means (not shown) such as a ring, to attach a chain or a rope. Near its rear end, FIG. 2, the shank is pierced with a transverse hole 3 through which there runs a transverse shaft 4. Relative to shaft 1, shank 1 therefore is made up of a fore arm lA and of a very short rear arm lB.

On each side of shank 1, the shaft 4 is welded to a fluke 5. At the level of shaft 4, the spacing between the two flukes 5 is only slightly wider than the thickness of the shank. The flukes 5 are co-planary and symmetrical. They are pointed at the fore, becoming wider toward the rear over approximately two thirds of their length, then becoming narrower up to their rear edge that is parallel with shaft 4. Their internal longitudinal side is rectilinear and their external longitudinal side is a line broken into two segments. The internal sides of the two flukes are divergent forward.

In their rear corner close to the shank, the two flukes 5 show an approximately square cut-out the fore side of which is located slightly to the rear of shaft 4. The length of those cut-out sides is approximately equal to one third of the greatest width of flukes 5.

To the fore edge of each cut out are welded two rectangular places or ledges 6 rearward directed, the width of which is that of the cut-outs. The ledges 6 of each fluke 5 are symmetrical relative to the plane of the latter and they form between themselves an angle of approximately 90°. The value of that angle is given, of course, as an indication only, and it may be appreciably different. The ledges 6 have as their main function to slant the anchor flukes on the bottom, to impart to them a tendency to sink in.

Figure 3:
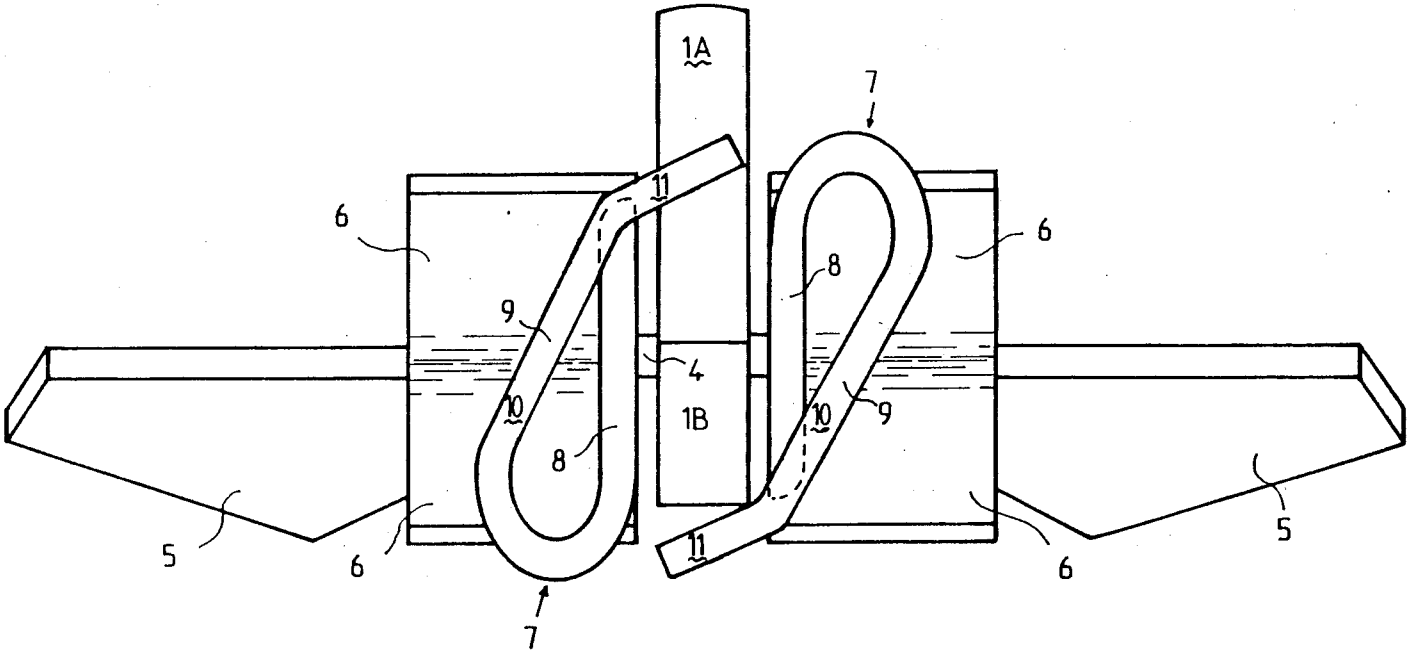
FIG. 3 is a rear enlarged view of the anchor in FIG. 1.

To the unit formed by the two ledges 6 of the right hand fluke 5, when looking at FIG. 3, there is welded a hard but elastic steel wire 7 in the shape of a pin. One side 8 of pin 7 is welded by one end to the face of the low ledge 6, close to its internal edge, and it rises up to the internal end of the rear edge of the high ledge 6 facing it. The bend of pin 7 is directed toward the outside that is to say toward the right. The second side 9 of pin 7 comes back toward the inside in an oblique manner, that is to say toward the left. It goes down under the end of the first side 8, shifted to the rear, then under the arm 1B of the shank 1, between the flukes 5. From the bend, the second side 9 has an approximately rectilinear part 11 the slope of which is appreciably decreased. That second part 11 forms a low lug piece, when looking at FIG. 3, for the rear arm 1B of shank 1. The fluke 5 on the other side has a pin that is identical but is oppositely oriented, to form a lug piece 11 in the other direction, above the rear arm 1B. The first side 8 of the two pins 7, FIG. 3, form a passage that limits the transverse play of the rear arm 1B and therefore keeps it in the zone of action of the lug pieces 11. The bends of the pins 7 may have one or several coils so as to lengthen the wire and to obtain the desired elasticity toward the end of sides 9.

Under normal conditions of operations, the shank 1 forms an angle of approximately 30° with the flukes 5 when it is in contact with one of the lug pieces 11. As there is conventionally provided, between the anchor and the boat, for a cord or a chain the length of which is three times longer than the height of the water, the force of traction from the boat to the anchor is approximately in the direction of the shank 1. Even when that force is important, the resulting force of the rear arm 1B on the active lug piece 11 is weak. An efficient anchoring is therefore assured.

When a pulling action is exerted on the chain or on the cord, to pick up the anchor, there occurs a time at which the boat is in an approximately vertical position relative to the end of shank 1. In that case, if the anchor is hooked on the bottom, a moderate vertical traction at the end lA of the shank will produced, through the rear arm 1B of the shank, an important force on the active lug piece 11. The latter, because of the elasticity of pin 7, will disappear, and the shank will be able to pivot freely relative to the flukes 5. It will then be easy to unhook the anchor.

In order to place the rear arm 1B of the shank back into place between the two lug pieces 11, there may be be provided for a key that makes it possible to separate the second side 9 from pin 7 in order to open the passage. In an example of an execution that proves satisfactory, said pincers are formed of a relatively long handle with, close to one end, two fingers perpendicular to the handle and parallel to each other, the spacing of which is slightly larger than to the diameter of the pin'.

Figure 1:
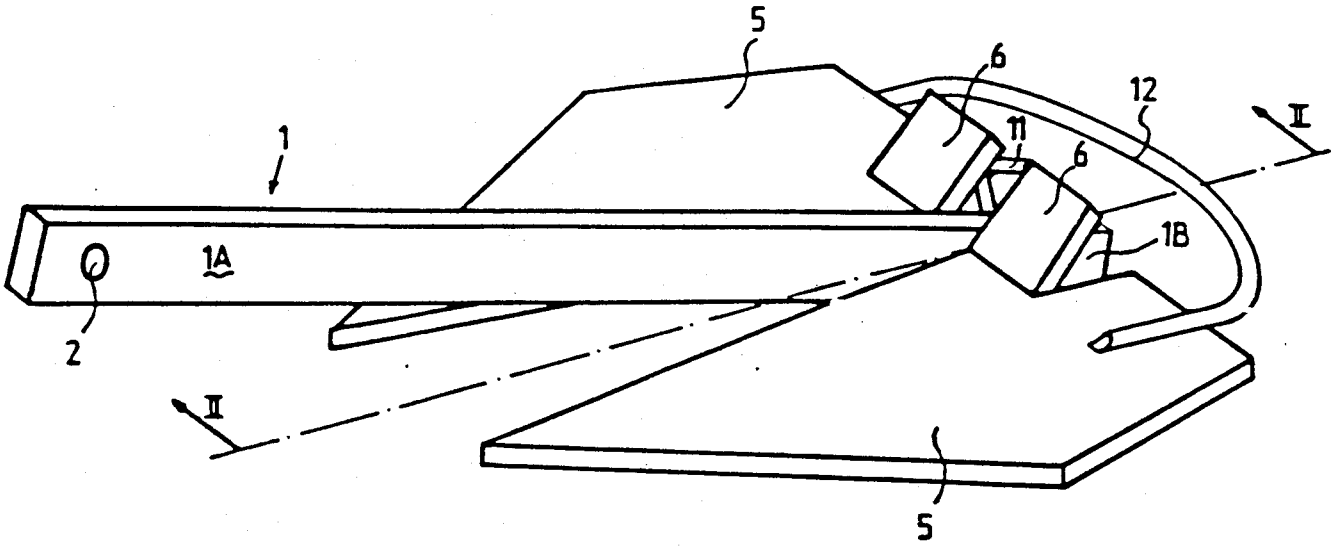
FIG. 1 is a perspective view of an anchor according to the invention.

Preferably, connection other than shaft 4 is provided for between the two flukes 5 of the anchor, especially in order to prevent the spinning of shaft 4. In an especially satisfactory embodiment, that connection is a rear arch 12, FIGS. 1 and 2, made of a rigid metal wire, the arm ends of which are respectively welded to the rear parts of the two flukes 5. Of course, arch 12 passes beyond the free end of the rear arm 1B of shank 1 in order not to hinder its pivoting. For reasons of clarity, arch 12 has not been represented in FIG. 3. Arch 12 also serves as a handle to move the anchor and, possibly, as a point to tie the latter on board.

Figure 4:
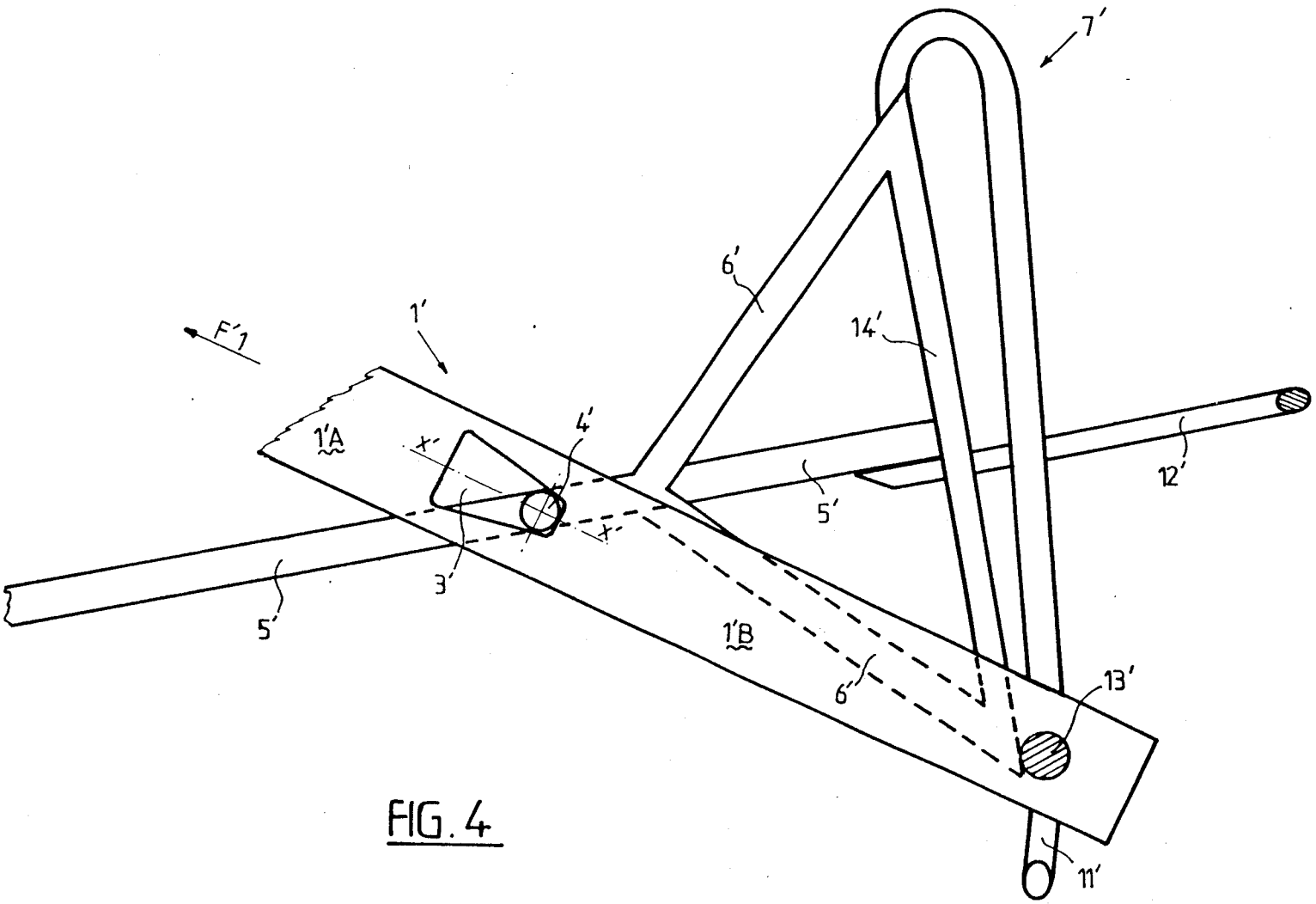
FIG. 4 is a section view, similar to that in FIG. 2, that shows a variation of the anchor shown in FIGS. 1 to 3, equiped with complementary means that limit the pivoting of the shank between the flukes, said complementary means being engaged.
Figure 5:
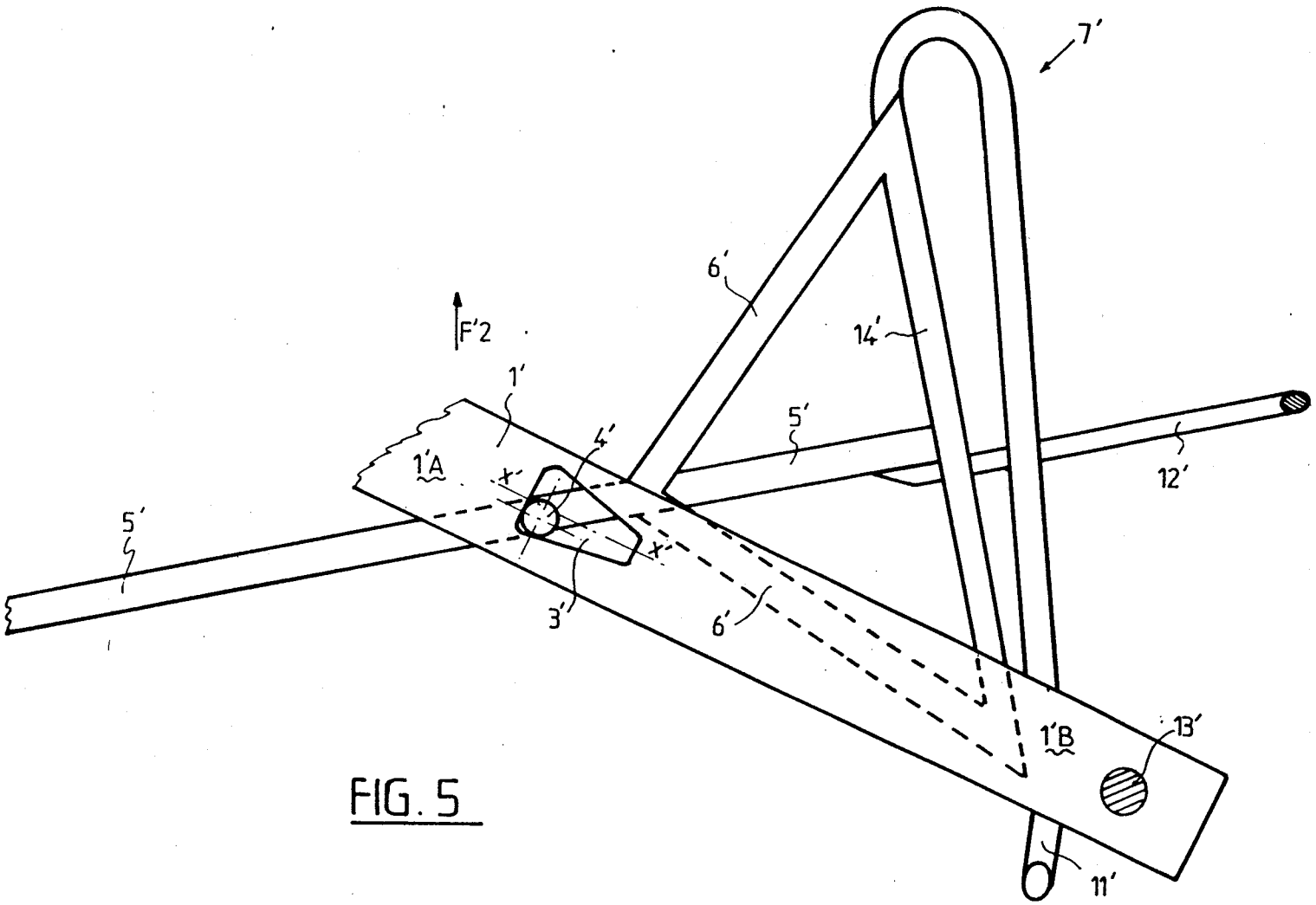
FIG. 5 is a section view corresponding to FIG. 4, that shows the complementary means disengaged.
Figure 6:
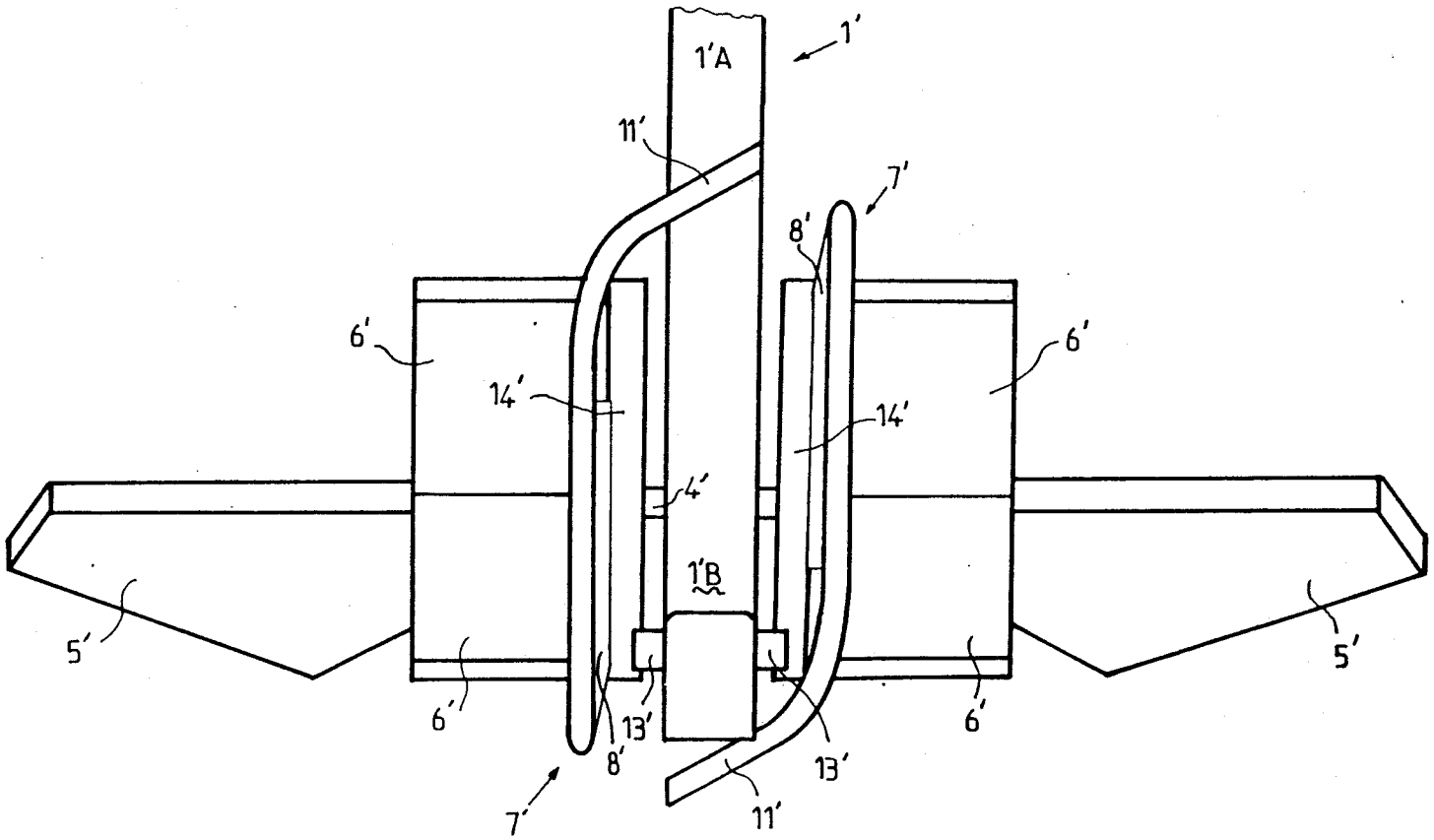
FIG. 6 is a rear view of the anchor in FIGS. 4 and 5.

The anchor in FIGS. 4 to 6 includes all of the elements of the above-described anchor, the numerical references used being, to designate the same elements, respectively given a simple ' mark, that is to say it includes a shank 1' forming two arms 1'A and 1'B on each side of a transverse hole 3' through which there runs a shaft 4' joining two co-planary flukes 5' the rear sides of which are respectively equiped with ledges 6' to which are welded pin-shaped wires 7' that form elastic lug pieces to limit the pivoting of shank 1'.

Instead of being round as hole 3 is, hole 3' is an oblong aperture, in the shape of a truncated triangle the axis of symmetry X'—X' is one and the same with the longitudinal axis of the shank 1' and the long base of which is located to the fore. Inside aperture 3', shaft 4 that joins the flukes 5' can appreciably move from the fore to the rear and vice-versa, hence a possibility of relative longitudinal displacement of shank 1' relative to the flukes 5'.

Between the two ledges 6' respectively associated with each fluke 5' there is provided for a small bar 14' that joins their internal rear corners, that is to say those that are not adjacent to fluke 5'. To the external edge of the small bar 14' there is welded wire 8' of the pin 7', FIG. 6.

The rear arm 1'B of the shank 1' has on its two lateral faces two stop-pins 13', symmetrical. Preferably, the stop-pins 13' are cylindrical. The position of the stop-pins 13' on the arm 1'B is such that they are each supported against a small bar 14', close to the lower end, FIG. 4, when shaft 4' is in the rear part of aperture 3', and when arm 1'B rests on the wire part 11', on the same side, of one of the two pins 7'. In that way, when shaft 4' is in the fore part of the aparture 3', FIG. 5, the stop-pins 13' have gone beyond, rearward, the end of small bar 14' as well as said part 11' of pin 7.

In operation, the anchor that has reached the bottom and subjected to a forward force vector (exerted) on the shank 1', in the direction of arrow F'1, finds itself in the situation shown in FIG. 4: shaft 4 is in the rear part of aperture 3', in abutment against the rear side of the latter, and the stop-pins 13' are in abutment against the small bars 14', very close to their lower ends. If the force stops, the shank 1' under the action of its own weight, is subjected to two motions: on the one hand a pivoting of the fore arm downward and, on the other hand, a sliding rearward until the shaft 4' is in abutment against the fore side of aperture 3'. The stop-pins 13' then are relased relative to lug piece 14'. If, again, a forward force is exerted on shank 1', the reverse movement takes place, that is to say, simultaneously shank 1' moves forward until shaft 4' is in abutment against the rear side of the aperture 3' and the fore arm 1'A rises.

The part 11' of pin 7' guides the rear arm 1'B of shank 1' so that the stop-pins again find themselves against the end of the small bar 14' when shaft 4' is in abutment at the rear of aparture 3'. Afterwards, if the force on shank 1' becomes strong, it is the stop-pins 13' that will absorb the reaction force, and not the elastic lug pieces 11'. The latter, therefore may be clearly less resistant than in the preceding embodiment, their functions being only to guide shank 1' to bring stop-pins 13' back before the corner of the small bars 14', to limit the pivoting when the anchor is not working, and to disappear under the conditions that will now be described.

When the anchor has to be picked up, at a certain point the force f'2 at the fore end of shank 1' is vertical, FIG. 5. IF the anchor is normally buried in sand or in mud, it is released simply under the action of the above-described forces. If it is hooked, under a rock for example, it becomes necessary in a first move, to release if need be the stop-pins 13' from the lug pieces 14'. To that end, from a vertical position, the end of shank 1' is given some slack. The latter, as explained above, then simultaneosuly pivots and slides until shaft 4' is in abutment against the fore end of aperture 3', the stop-pins 13' thus being disengaged from lug pieces 14'. By again pulling vertically on shank 1', FIG. 5, the fore of aperture 3' comes to abut, by its lower side, against shaft 4', and a moment is brought about, that tends to cause shank 1' to pivot clockwise relative to shaft 4'. The stop-pins 13' being released from lug pieces 14', the reaction force exerts itself, through the rear arm 1'B, on the pin part 11' in contact with the latter. When force F'2 becomes sufficient, the part 11' disappears and releases the shank relative to the flukes 5'. The anchor then can be easily unhooked. As already indicated, the lug pieces 7' can be relatively flexible, that is to say easily made to disappear, because they are not pulled or attracted when the anchor is working. It will be noted, FIG. 4, that if at the time when the vertical force f'2 is exerted on the shank 1' to unhook the anchor, shaft 4' has remained in the rear part of aperture 3' for any reason, the moment that is brought about has a tendency to release stop-pins 13' downward, that is to say, to release them from the small bars 14'. In such a situation, in order to unhook the anchor, the only thing necessary is for force f'2 to be more important.

Figure 7:
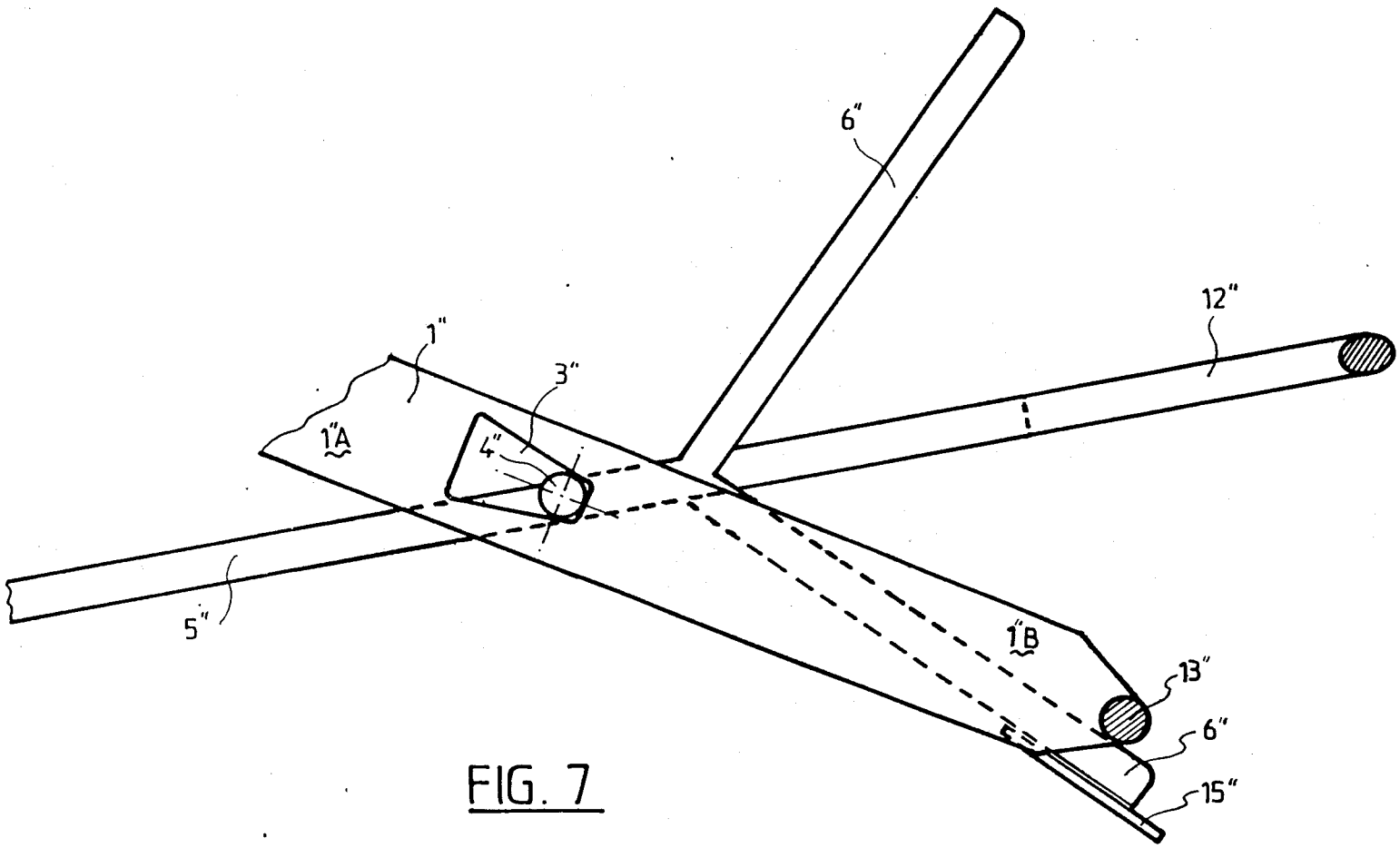
FIGS. 7 to 9 show a second variation of the anchor shown in FIGS. 4 to 6.
Figure 8:
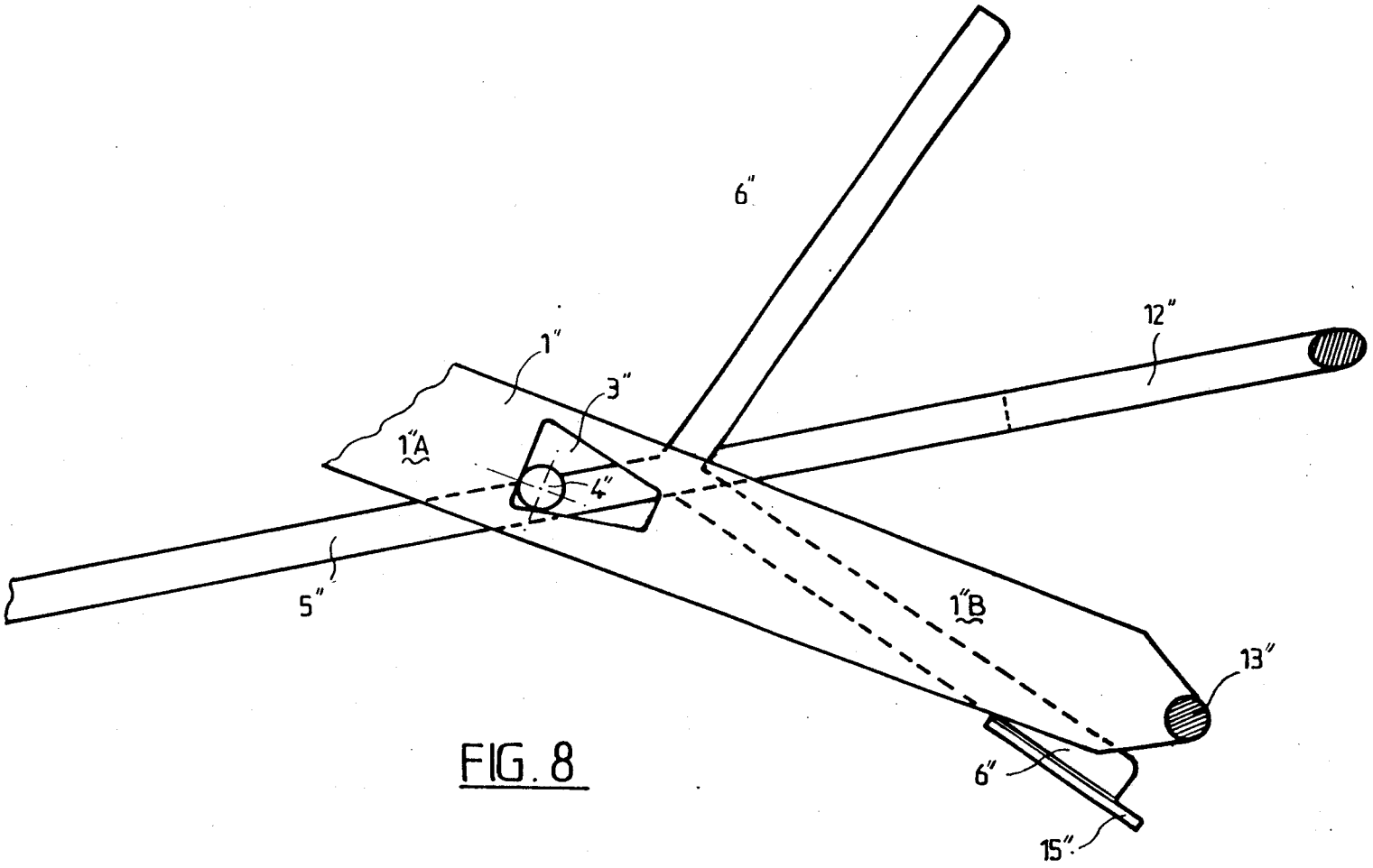
Figure 9:
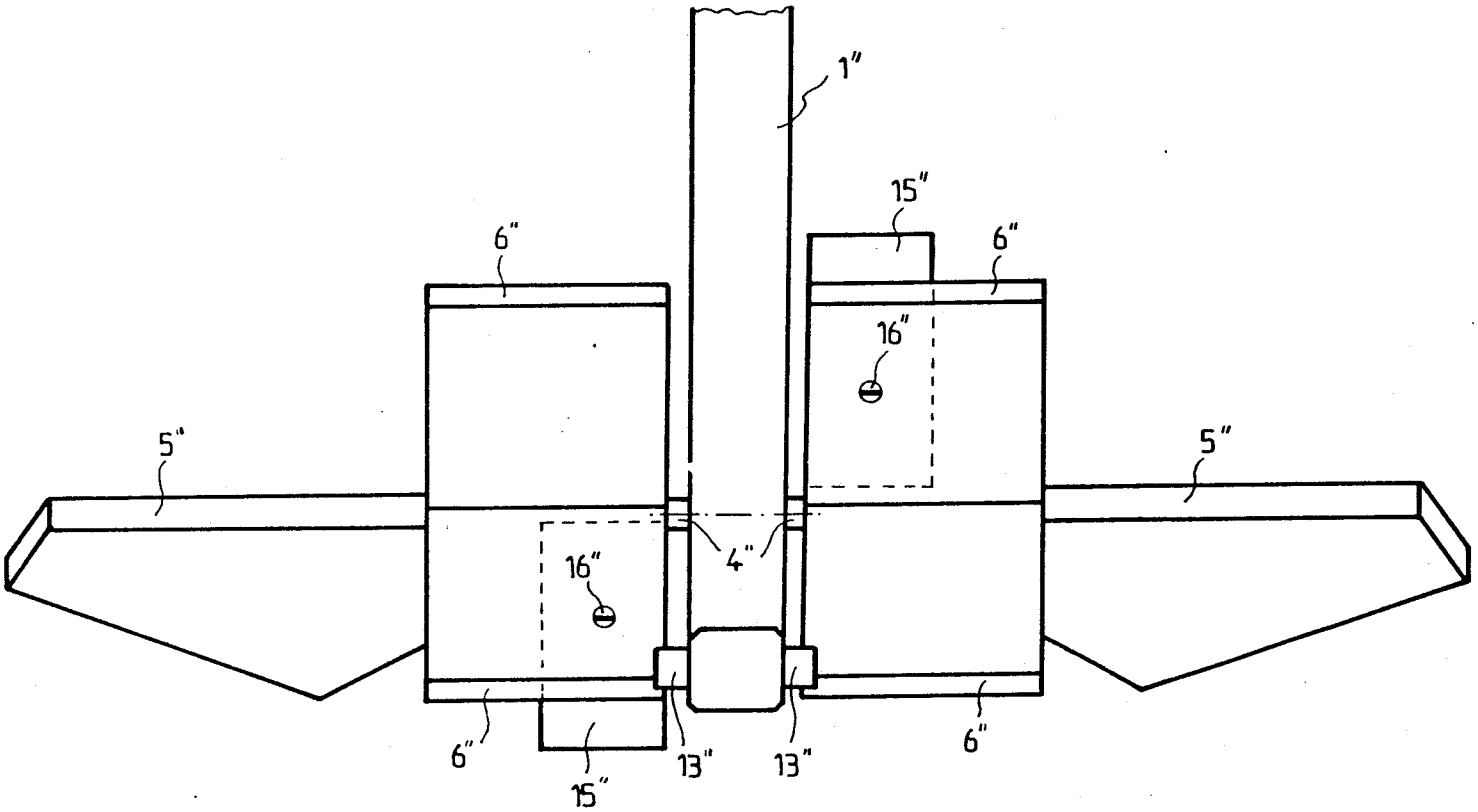

The anchor in FIGS. 7 to 9 also has elements of the above-described anchors, the numerical references of the same elements being given, respectively the mark ", that is to say it includes the shank 1" forming two arms 1"A and 1"B on each side of a transverse aperture 3" through which there runs a shaft 4" that joins two coplanary flukes 5", the rear sides of which respectively are equiped with ledges 6". Aperture 3" has the same oblong shape as aperture 3", and shaft 4" can move in it in the same manner as shaft 4' in aperture 3' of the above-described anchor.

The rear arm 1"B has at its free end two stop-pins 13", similar to stop-pins 13'. In each pair of ledges 6", the back of one (of them) at least is fitted with a small plate 15" that extends it over a short length. In practice, the small plate 15" must laterally occupy, at the back of a ledge 6", a place that makes it possible for it angularly to limit the movement of the stop-pins 13" in one direction. Finally, there have been shown in FIGS. 7 and 8 grooves 16" on the small plates 15", these grooves being breaking starts for these small plates.

In operation, the anchor that has reached the bottom, and is subjected to a forward force of the shank 1", finds itself in the situation shown in FIG. 7: shaft 4" is in the rear part of aperture 3", in abutment against the rear side of the latter, and the stop-pins 13" respectively are in abutment against the internal faces of two ledges 6" located in a same plane and respectively associated to the flukes 5". If force stops, the shank 1", under the action of its own weight, is subjected to two motions: on the one hand a pivoting of the fore arm 1"A downward and, on the other hand, a sliding rearward until shaft 4" is in abutment against the fore side of aperture 3". The stop-pins 13" then assume a position close to that shown in FIG. 8. If, again, a forward force is exerted on the shank 1", the reverse motion occurs, and we are back at the position in FIG. 7.

When the anchor in FIGS. 7 to 9/, at a certain point in time a force at the free end of the shank 1" is vertical. If the anchor is buried under normal conditions, it will be released. If it strongly hooked, it becomes necessary, in a first step to give some slack to the free end of the fore part 1"A of shank 1". The latter pivots and slides until shaft 4" is in abutment at the fore of aperture 3", the stop-pins 13" being beyond the rear edges of the involved ledges 6". By again vertically pulling on shank 1", the fore part of aperture 3" comes into abutment against shaft 4" and the traction tends to cause shank 1" to pivot around shaft 4", in a clockwise direction when looking at FIG. 8. As the stop-pins 13" have gone beyond the rear edges of the involved ledges 6", they come into abutment against a small plate 15" that breaks under the stress, this making it possible to unlock the shank and therefore to recover the anchor the flukes 5" of which hang vertically.

As an example, there have been shown screws 17" to fix the small plates 15" to the back of the ledges 6", but it would be possible to use other rapid fixation means to replace, if need be, a broken small plate. It will be understood that two small plates are sufficient, one on one side of the shank and the other on the other side.

The anchor according to the invention is very dependable and very efficient. It is easy to use and free from danger. Finally, it will be noted that, in the variation shown in FIGS. 7 to 9, the means used are extremely simple.

Figure 10:
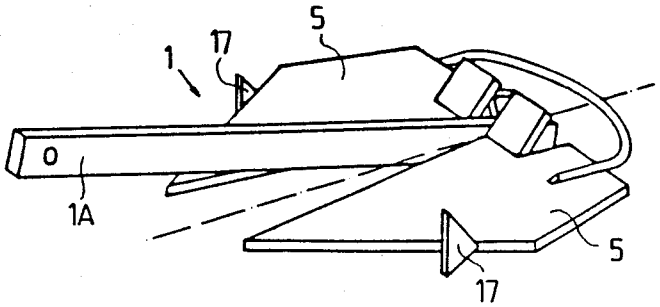
FIG. 10 shows another variation of the anchor in FIG. 1.

In FIG. 10, there is shown an anchor according to the invention in which, on the fore external edge of each fluke 5 there is welded a small lug piece 17, perpendicular to the plane of the fluke, the fore edge of which is vertical and the rear edge has any shape, but preferably a triangular one. Lug piece 17 makes it possible to retain in front of it chains or ropes dragging on the sea bottom. The chains are thus prevented from becoming entangled in the rear part of the anchor.

We claim:

1. A marine anchor equipped with anchor weighing means, comprising two symmetrical flukes (5") joined by transverse shaft (4"), each of said flukes being fitted with a pair of symmetrical ledges (6") and, a shank (1") between said flukes (5"), said shank (1") pivoting around said transverse shaft (4") that joins the two flukes (5"), so as to form relative to said shaft (4") a fore arm (1"A) and a rear arm (1"B) carrying transverse stop-pins (13"), characterized in that a truncated triangular aperture (3") is provided in the shank, the directions of a longitudinal axis perpendicular to the base of said truncated triangle coinciding a longitudinal axis of said shank; for the passage of said shaft (4") that joins the flukes (5"), the stop-pins coming into abutment against the ledges (6") of the flukes when the shaft (4")

is in a rear part of the aperture (3″), the stop-pins (13″) being disengaged from said ledges when the shaft (4″) is in a rear part of the aperture (3″), the stop-pins (13″) being disengaged from said ledges when the shaft (4″) is in a fore part of the aperture (3″), a long base of said truncated triangle being located toward the fore part, and elastic or breakable lug pieces for limiting, under normal conditions, the movements of the stop-pins (13″) when the latter are disengaged from said ledges (6″).

2. A marine anchor according to claim 1, characterized in that said lug pieces are resilient wires shaped as pin (7″), a first side (8″) of which is welded to one fluke (5″), and a second side of which (9″) forms a lug piece (11″) between the two flukes (5″).

3. A marine anchor according to claim 2, characterized in that the first side (8″) of each stop pin (7″) is welded to two ledges (6″) symmetrically placed on each side of each fluke (5″), in an internal rear corner of same.

4. A marine anchor according to claim 3, characterized in that the first sides (8″) of the two stop pins (7″) form a passage that limits the transverse play of said rear arm (1″B) of the shank (1″) and holds the latter within the active zone of the lug pieces.

5. A marine anchor according to claim 1, characterized in that the breakable lug pieces are small plates (15″) that extend rearwardly beyond one part of the fluke.

6. A marine anchor according to one of claims 1 to 5, characterized in that, a relatively small vertical lug piece is placed on a forward external edge of each fluke.

* * * * *